United States Patent [19]

Dennis

[11] Patent Number: 4,749,052

[45] Date of Patent: Jun. 7, 1988

[54] CUTTING ELEMENT ADAPTED TO BE PUSHED INTO A RECESS OF A DRILL BIT BODY

[75] Inventor: Mahlon D. Dennis, Kingwood, Tex.

[73] Assignee: Diamant Boart-Stratabit (USA) Inc., Houston, Tex.

[21] Appl. No.: 947,359

[22] Filed: Dec. 29, 1986

[51] Int. Cl.[4] ..... E21B 10/46

[52] U.S. Cl. ..... 175/329; 175/410; 29/525

[58] Field of Search ..... 175/329, 374, 410, 409, 175/411; 76/108 R, 108 A; 29/525

[56] References Cited

U.S. PATENT DOCUMENTS

| | | | |
|---|---|---|---|
| 4,271,917 | 6/1981 | Sahley | 175/410 |
| 4,325,439 | 4/1982 | Vezirian | 175/329 |
| 4,343,371 | 8/1982 | Baker, III et al. | 175/374 |
| 4,359,112 | 11/1982 | Garner | 175/329 |

*Primary Examiner*—Stephen J. Novosad
*Assistant Examiner*—Terry Lee Melius
*Attorney, Agent, or Firm*—Burns, Doane, Swecker & Mathis

[57] ABSTRACT

A cutting element of the type which is pushed into a preformed hole of a drill bit by means of a pusher tool. The cutting element comprises a generally cylindrical stud having an inclined support face adjacent a forward end of the stud. A polycrystalline diamond substance is disposed on the support face. A non-circular tool recess is formed in the forward end of the stud and behind the support face and is configured to receive a pusher tool for confining pushing forces to the region of the recess as the cutting element is pushed into the preformed hole. The cutting element can also be rotated by the tool for repositioning the cutting element after installation, or loosening the cutting element to facilitate its removal.

4 Claims, 1 Drawing Sheet

FIG. 1
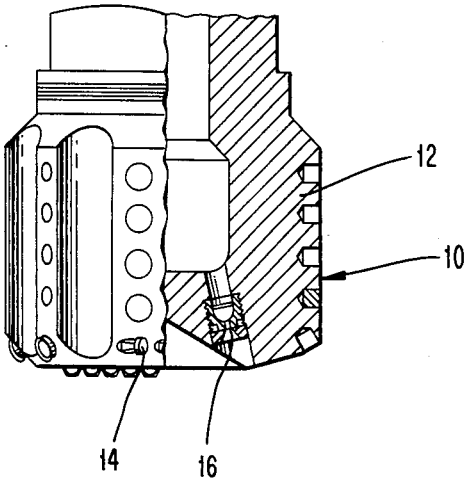
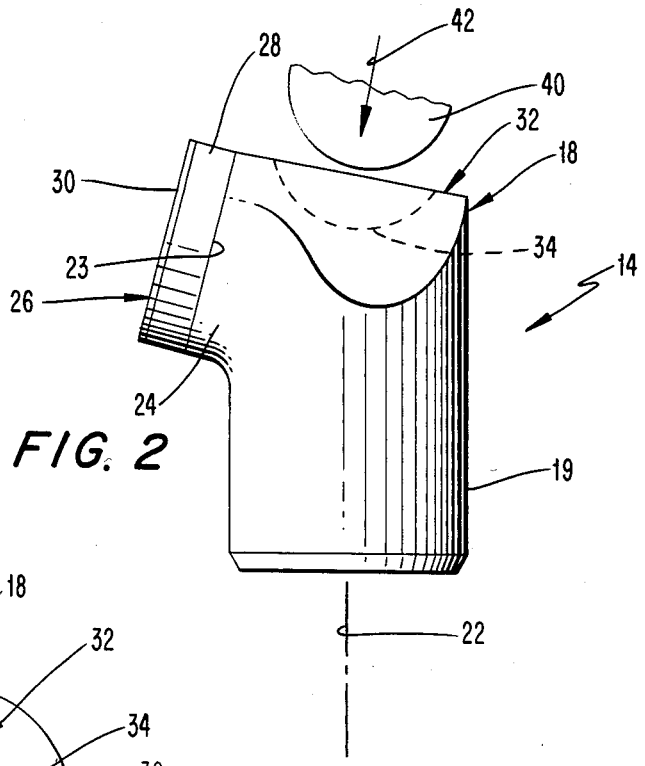
FIG. 2
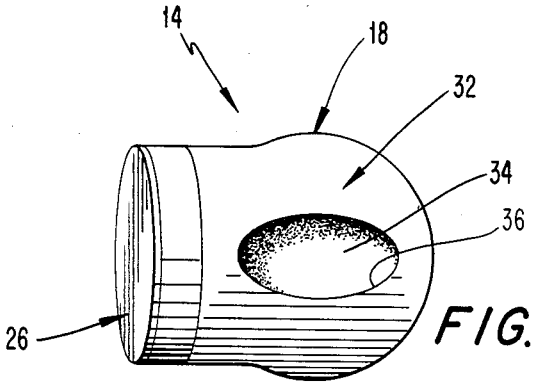
FIG. 3

CUTTING ELEMENT ADAPTED TO BE PUSHED INTO A RECESS OF A DRILL BIT BODY

BACKGROUND AND OBJECTS OF THE INVENTION

The present invention relates to cutting elements for drill bits and, in particular, to cutting elements which facilitate installation in a drill bit.

One type of cutting element used in rotary drilling operations in earth formations comprises an abrasive composite or compact mounted on a stud. The composite typically comprises a diamond layer adhered to a cemented carbide substrate, e.g., tungsten carbide cemented by a metal binder such as cobalt. The substrate is brazed to the stud and the stud is mounted in a drill bit by being installed into predrilled holes in the drill bit and is secured therein by press-fit or by brazing. Such a cutting element is depicted, for example, in U.S. Pat. No. 4,325,439.

Installation of the cutting element is performed by means of a pusher tool which engages the top of the cutting element and pushes it into the predrilled bore in the drill bit. The pusher tool typically is of inverted U-shape, e.g., yoke-shaped, having a pair of legs which straddle the sides of the cutting element (e.g., see U.S. Pat. No. 4,325,439 disclosing a pusher 50). In performing the pushing operation, downward forces applied to the composite tend to shear the composite off the stud. Furthermore, in the case of a stud possessing an extension or boss upon which the composite is mounted as disclosed in copending Application Ser. No. 06/804,864, filed December 5, 1985, such downward forces may bend the boss in cantilever fashion and cause it to break off.

SUMMARY OF THE PREFERRED EMBODIMENT OF THE INVENTION

These objects are achieved by the present invention which relates to a cutting element of the type which is pushed into a preformed hole of a drill bit by means of a pusher tool. The cutting element comprises a generally cylindrical stud having a rear end and a forward end. The forward end includes a support face which is inclined at an acute angle relative to a longitudinal axis of the stud. A polycrystalline diamond substance is carried by the support face. A tool recess is formed in the forward end of the stud behind the support face and is configured to receive a pusher tool for confining pushing forces to the region of the recess. Preferably, the tool and recess are non-circular in cross-section to enable the cutting element to be rotated by the tool.

The present invention also relates to a method in which the end of a pusher tool is inserted into a tool recess disposed in the forward end of a stud behind the support face. The recess functions to confine the pushing forces to the region of the recess as the stud is pushed into the preformed hole of the drill bit.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is a side elevational view of a drill bit, with a portion thereof broken away;

FIG. 2 is a side elevational view of a cutting element according to the present invention, with a pusher tool approaching a recess of a cutting element; and FIG. 3 is an end view of a forward end of the cutting element.

DETAILED DESCRIPTION OF A PREFERRED EMBODIMENT OF THE INVENTON

Depicted in FIG. 1 is a drill bit 10 comprising a drill bit body 12 which carries a plurality of cutting elements 14 in a front cutting face of the bit. The cutting elements are cooled and cleaned by drilling fluid which is ejected from nozzles 16.

Each cutting element 14 comprises a stud 18 formed by a shank 19 and a boss 24. The shank 19 includes an outer cylindrical surface which defines a main longitudinal axis 22 of the shank 19. The boss 24 extends from a forward portion of the shank 19 at an acute angle relative to the longitudinal axis 22. The boss forms an inclined support face 23 of the stud. The stud is preferably formed of a cemented carbide such as cemented tungsten carbide.

Mounted on the support face 23 of the boss 24 is an abrasive compact 26 which comprises a substrate 28 and a polycrystalline diamond layer 30. The substrate 28 is brazed to the end of the boss and the diamond layer 30 is sintered onto the outer end of the substrate.

Formed in the front or crown end 32 of the stud behind the compact 26 and boss 24 is a recess 34. The recess can be of any suitable shape as viewed from the end (FIG. 3) but preferably is non-circular, such as oval (as depicted) or polygonal for example. The recess 34 is configured to receive a correspondingly shaped end of a pusher tool 40. The tool 40 is thus able to enter the recess 34 and abut the surface 36. Rearward forces 42 applied to the tool 40 are transmitted to the stud 18 to push the stud into a predrilled hole in the drill bit. Those forces will be confined to the region of the recess 34 without overstressing the boss or compact. The cutting element is retained in the hole by press-fit or by brazing.

The recess preferably occupies at least 30% of the area of the crown surface 32 and is of non-uniform depth and non-uniform width. The depth of the recess is not critical as long as the depth is sufficient to retain the end of the tool in the recess. As a result, there is no risk that the compact or the boss will be broken off during the installation process.

It is preferred that the recess 34 and tool be of non-circular shape (e.g., oval or polygonal) to enable the tool to rotate the cutting element. That is, after being installed, the cutting element may need to be reoriented, or prior to being removed, the cutting element may need to be loosened. These functions can be achieved by employing the tool to rotate the cutting element.

The recess 34 according to the present invention also has utility in cutting elements which do not contain a boss 24, because the recess will isolate the pushing forces from the compact and prevent the compact from being sheared-off.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What I claim is:

1. A method of pressing a cutter element into a preformed hole of a drill bit, said cutter element comprising a generally cylindrical stud with a support face disposed at a forward end of said shank and oriented at an acute angle relative to a longitudinal axis of said stud, and a polycrystalline diamond substance carried by said support face, said method comprising the steps of:

inserting an end of a pusher tool into a tool recess of non-uniform depth disposed in said forward end of said stud behind said support face, and applying longitudinal pushing forces to said tool to push said stud into said hole, with said pushing forces being confined to the region of said recess.

2. A method according to claim 1, wherein said recess is non-circular, said method including the step of rotating said cutting element by applying turning forces to said tool.

3. A method of pressing a cutter element into a preformed hole of a drill bit, said cutter element comprising a generally cylindrical stud with a support face disposed at a forward end of said shank and oriented at an acute angle relative to a longitudinal axis of said stud, and polycrystalline diamond substance carried by said support face, said method comprising the steps of:

inserting an end of a pusher tool into a tool recess of non-uniform width disposed in said forward end of said stud behind said support face, and applying longitudinal pushing forces to said tool to push said stud into said hole, with said pushing forces being confined to the region of said recess.

4. A method according to claim 3, wherein said recess is non-circular, said method including the step of rotating said cutting element by applying turning forces to said tool.

* * * * *